US005829609A

United States Patent [19]

Beck

[11] Patent Number: 5,829,609

[45] Date of Patent: Nov. 3, 1998

[54] TWIST TOP CHILD-RESISTANT CLOSURE

[75] Inventor: James M. Beck, Buffalo Grove, Ill.

[73] Assignee: Creative Packaging Corp., Buffalo Grove, Ill.

[21] Appl. No.: 728,832

[22] Filed: Oct. 10, 1996

[51] Int. Cl.[6] ..... B65D 55/02

[52] U.S. Cl. ..... 215/217; 215/206; 215/224

[58] Field of Search ..... 215/206, 214, 215/217, 222, 216, 218, 219, 224, 225, 303, 321, 329, 330, 332

[56] References Cited

U.S. PATENT DOCUMENTS

| | | | |
|---|---|---|---|
| 3,376,991 | 4/1968 | Deaver | 215/217 |
| 3,675,804 | 7/1972 | Micalief . | |
| 3,695,475 | 10/1972 | Ruekberg . | |
| 3,794,200 | 2/1974 | Marks . | |
| 3,923,181 | 12/1975 | Libit . | |
| 3,955,696 | 5/1976 | Finke . | |
| 3,984,021 | 10/1976 | Uhlig | 215/216 |
| 4,134,513 | 1/1979 | Mumford | 215/214 X |
| 4,270,664 | 6/1981 | Buono | 215/217 X |
| 4,298,129 | 11/1981 | Stull . | |
| 4,335,823 | 6/1982 | Montgomery et al. | 215/206 |

*Primary Examiner*—Jes F. Pascua
*Attorney, Agent, or Firm*—Silverman, Cass & Singer, Ltd.

[57] ABSTRACT

A child-resistant closure for a container having a neck and a mouth covered by a flexible cap of inverted cup shape. The container neck includes an outwardly projecting, ramped rib having a lower ramp end. The cap has at least one projection extending inwardly from a sidewall, with the projection being normally positioned radially spaced outside of the ramped rib, but being manually movable inwardly with the side wall to engage the ramped rib near the lower end in a predetermined rotational position of the cap. A detent member hold the cap in a position closing the container mouth but permitting cap rotation. The sidewall may be squeezed to engage the projection and ramped rib, and rotated in one direction, with the ramped rib raising the projection, to force the cap upwardly to open the container by disengaging the detent member from its cap-holding position.

10 Claims, 3 Drawing Sheets

TWIST TOP CHILD-RESISTANT CLOSURE

BACKGROUND OF THE INVENTION

1. Field of the Invention

This invention relates generally to closures for containers, and more particularly, to such closures which include structure to render them child-resistant to opening.

2. Description of Related Art

Child-resistant closures are known and include, for example, the invention disclosed in Libit U.S. Pat. No. 3,923,181 which includes a cap that is removable from a container top by simultaneously squeezing the cap on two opposite sides to engage inwardly projecting threads with a helical member on the neck of the container, and then rotating the cap.

Some users of child-resistant closures may not realize the direction of rotation of the cap that must be effected in order to open such closures. Of course, the cap must be rotated in the direction that causes the helical member on the container neck to urge the cap upwardly to disengage the cap from the container, and to thus release the cap.

By the present invention, the user of the closure is guided to rotate the cap in the proper direction for removal, since the cap will not turn in the improper direction for opening.

SUMMARY OF THE INVENTION

The invention provides a child-resistant closure including a cap for engagement on a container top. The container includes a neck and a mouth, which is covered by a flexible cap of inverted cup shape. Typically, the container neck carries an outwardly projecting ramped rib having a lower ramp end. The container neck also may carry a vertical rib which is circumferentially separated by a space from the ramped rib adjacent to the lower ramp end of the rib.

The removable cap carries at least one projection extending inwardly from a flexible sidewall of the cap. The projection normally is positioned radially outside of the ramped rib by the natural shape of the flexible sidewall. The projection is movable manually inwardly along with the sidewall to engage the ramped rib near the lower ramp end thereof in a predetermined rotational position of the cap.

A detent member also is provided for holding the cap in position closing the container mouth, but permitting cap rotation. Typically, the detent member can be a conventional snap ring system comprising a cap annular rib extending inwardly from the cap sidewall, and a container annular rib extending outwardly from the container neck above the cap annular rib. This construction resists removal of the cap without application of a high removal force, such as may be provided by the engagement of the projection and the helical rib, and rotation of the cap in the proper direction.

Thus, the cap sidewall may be squeezed to engage the projection and ramped rib together. The cap may be rotated in one direction, with the rib raising the projection to force the cap upwardly. This opens the container by causing disengagement (separation) of the detent member from its cap-holding position.

However, if the cap is squeezed and rotated in the other direction, the projection of the cap engages the vertical rib of the container neck, to stop rotation. Thus alerted by the impossibility of rotation in that direction, the user will be guided to rotate the cap in the proper direction for opening.

The closure gains its child-resistant characteristic by the requirement that the cap must be both squeezed and rotated in order to be opened. Such action typically is beyond the capability of the average child.

It may be preferred for the container of this invention to have a pair of individual, ramped ribs carried in opposed position to each other. The cap may then have a pair of the projections described above also in opposed position to each other, and positioned to respectively engage the ramped ribs. Thus, the cap may be forced off of the neck by rotation in a balanced-force manner, with each ramped rib pressing one of the projections. If desired, more than two ramped ribs and projections may similarly be used.

It further is contemplated that the container and cap of this invention may have reversed parts from that described above, where the ramped rib is carried by the cap, and the projection is carried by the container neck. In this case the projection would be positioned higher, and would first engage the higher ramp end of the ramped rib, having the same effect as the cap is rotated in a proper direction for forcing the cap off of the neck.

DESCRIPTION OF THE PREFERRED EMBODIMENTS

Figure 1:
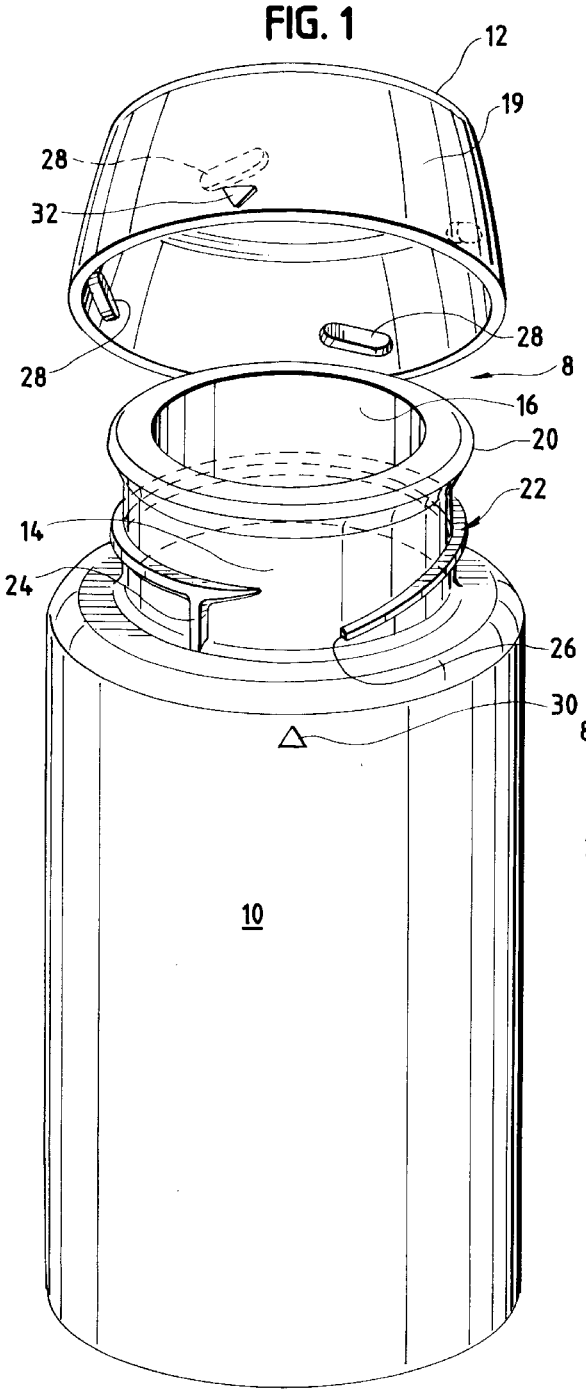
FIG. 1 is an exploded perspective view of a child-resistant closure constructed in accordance with this invention.
Figure 2:
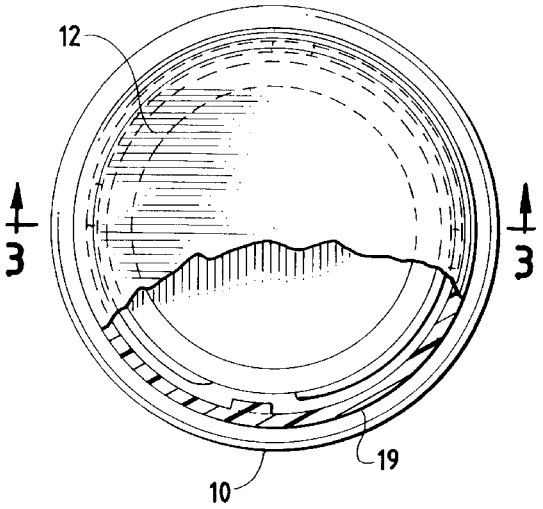
FIG. 2 is a top plan view of the container and cap of FIG. 1, with the cap attached to the container and a portion thereof broken away.
Figure 3:
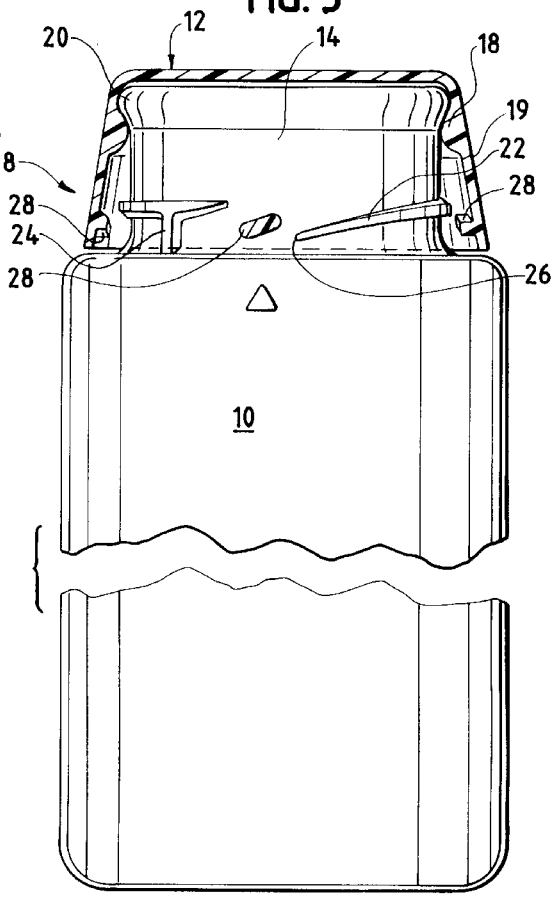
FIG. 3 is a sectional view taken along the line 3—3 of FIG. 2, in the direction indicated generally.

Referring to FIGS. 1 through 9, an embodiment of the child-resistant closure 8 is shown with removable cap 12 positioned on the top of container 10. Container 10 has a neck 14 and a mouth 16 which is covered by flexible, removable cap 12, particularly as shown in FIG. 3.

Cap 12 is retained on neck 14 by a snap ring arrangement which comprises cap annular rib 18 extending inwardly from cap side wall 19, and which engages with a container annular rib 20 extending outwardly from container neck 14 and positioned above cap annular rib 18. Thus, cap 12 is held in position on the container neck 14 by the container annular rib 20 in a snap-fit relationship, ribs 18, 20 together forming a detent member which holds the cap in a position closing the container mouth while permitting cap rotation. Since cap 12 is flexible, it may be disengaged from its container closing position shown in FIG. 3 when the cap is pressed upwardly with a high removal force.

The respective container 10 and cap 12 may comprise integrally molded pieces, with the various ribs and projections carried on each being an integral part of the molded objects.

Container neck 14 carries an outwardly projecting ramped rib 22; that is, ramped rib 22 defines a ramp along at least part of its length. Specifically in FIG. 1, rib 22 is helical, so that it defines a ramp over essentially all of its length.

Container neck 14 also defines a vertical rib 24, which is circumferentially spaced from the lower end 26 of the ramped rib 22, although it may be connected to another portion of the ramped rib.

Cap 12 is shown to carry a plurality of projections 28 that extend inwardly from cap sidewall 19. Furthermore, in the normal, unstressed configuration of flexible cap 12 as shown in FIG. 3, inwardly extending projections 28 normally are positioned radially spaced outside of ramped rib 22 and vertical rib 24 so that cap 12 is freely rotatable.

Figure 5:
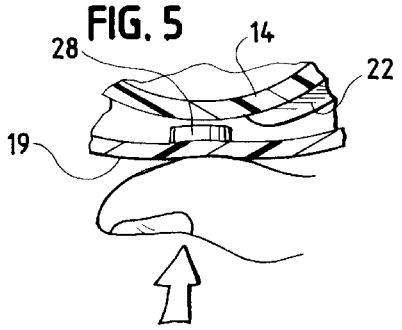
FIG. 5 is a fragmentary, sectional view taken along the line 5—5 of FIG. 4, showing how the flexible cap wall and the projection can be pressed inwardly to engage the helical rib.
Figure 6:
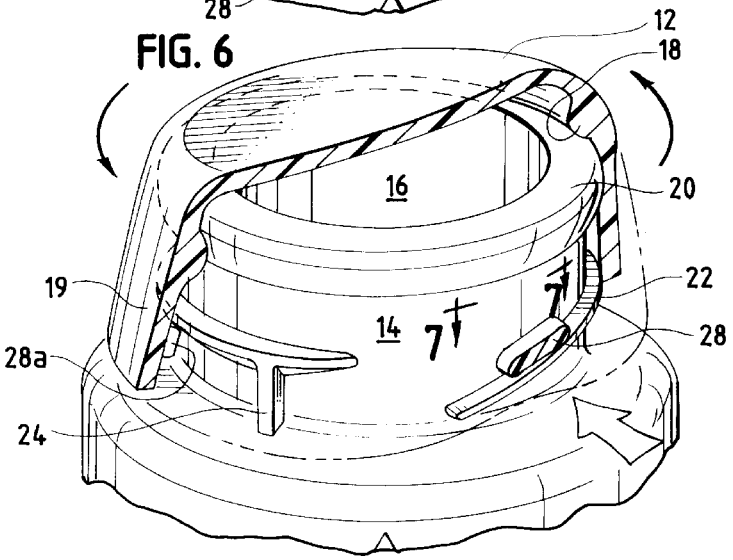
FIG. 6 is a view similar to FIG. 4, showing about 60° counterclockwise rotation of the cap with respect to the container and further showing how the projection can engage the helical rib near its lower end so that counterclockwise rotation drives the cap upwardly.
Figure 7:
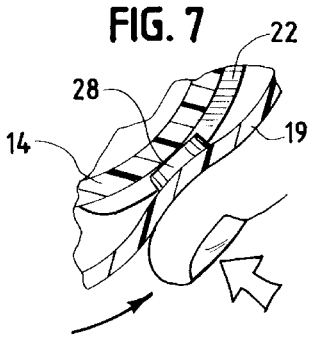
FIG. 7 is a fragmentary, sectional view taken along the line 7—7 of FIG. 6, in the direction indicated generally.

To open the container, a portion of flexible wall 19 must be squeezed inwardly to move at least one projection 28 inwardly so that it is of essentially the same radial distance from the container axis as is ramped rib 22, permitting projection 28 to overlie ramped rib 22, as shown in FIG. 5. Then, as cap 12 is rotated, as particularly shown in FIG. 6, projection 28 will be lifted upwardly by the ramping effect of helical rib 22. This action has the effect of driving cap 12 upwardly, away from container mouth 16, and causing disengagement of annular cap rib 18 from annular rib 20 of the container mouth. The rotation and removal process illustrated in FIG. 6 is shown to be only partially complete, but a larger segment of the respective retention ribs 18, 20 become separated as projection 28 is driven upwardly along ramped rib 22.

As cap 12 rotates counterclockwise, one of the projections 28*a* (FIG. 6) may approach vertical rib 24. However, if rib 28*a* is not carried on a portion of cap wall 19 that is inwardly deflected, projection 28*a* will pass over vertical rib 24, so that there will be no interference with the process of prying cap 12 out of its engagement with container neck 14.

Figure 4:
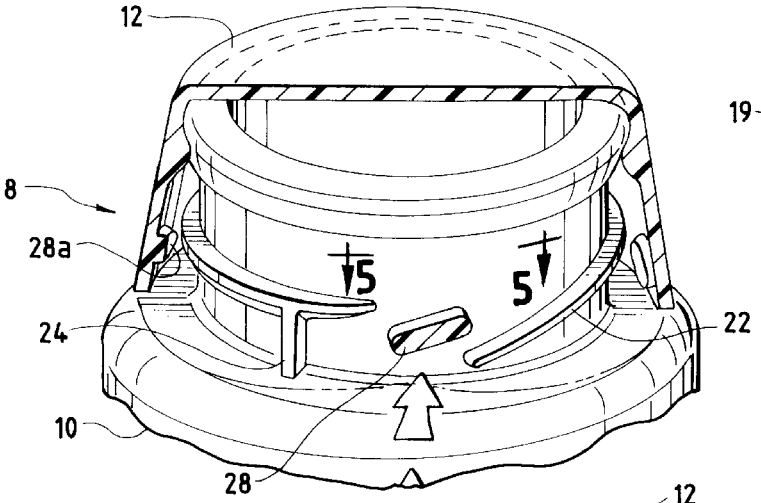
FIG. 4 is a fragmentary, perspective view of the top of the container and cap of FIGS. 1–3, with the cap taken substantially in section.

However, if a portion of cap wall 19 is depressed inwardly as shown in FIG. 5 to depress one of the projections 28, and cap 12 is rotated in the wrong direction for opening, namely the clockwise direction as seen in FIG. 4, it can be seen that in that circumstance a projection 28 will quickly engage vertical rib 24 to prevent further rotation, thus providing to the user an indication that the direction of rotation for opening is wrong. This encourages the user to rotate cap 12 in the other direction, causing it to engage ramped rib 22, for opening of the container.

Additionally, if the cap wall 19 is depressed inwardly to depress projection 28 at a location on the left side of vertical rib 24, as seen in FIGS. 4–8, and the cap is rotated in the counter clockwise direction, the projection 28 will abut rib 24 to prevent cap 12 from being further rotated and separated from container neck 14. This is an added safety feature to prevent an inexperienced person, such as a child, from opening the cap unless it is properly orientated with respect to the container neck.

Figure 8:
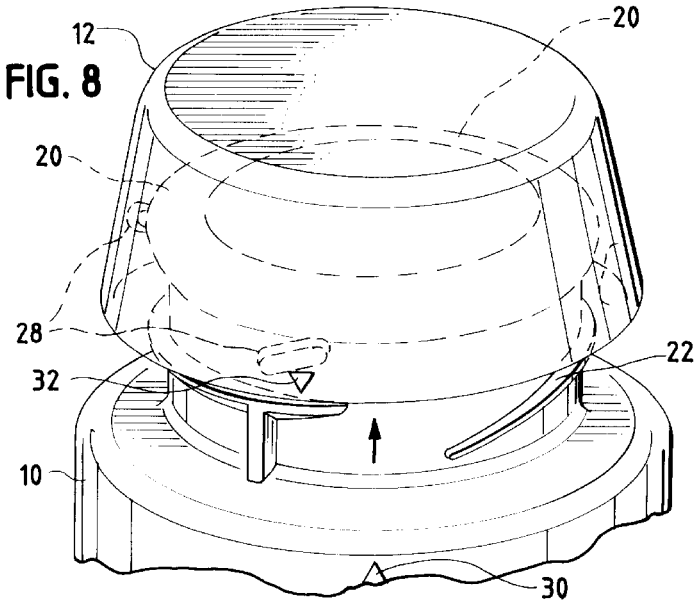
FIG. 8 is a perspective view of the container of the previous drawings, showing the cap in substantially removed configuration after a plurality of projections have been driven upwardly by the helical rib.

FIG. 8 shows the position of cap 12 at the end of the counterclockwise rotation process which results in disengagement of the respective annular ribs 18, 20, so that cap 12 may be lifted off of container 10. If desired, the cap annular retaining rib 20 may be sized to slightly engage the inner edges of cap projections 28, to provide a slight, second detent system so that the cap may be loosely held on container 10, but may be easily picked off by the hand.

Thus, a container is provided in which the removable cap rotates freely, but it cannot be opened without the coordinated action of pressing a portion of the cap wall inwardly while rotating the cap at the same time. Also, the cap is prevented from rotation in the wrong direction for opening when a user depresses the cap sidewall to push a cap projection inwardly, thereby indicating to the user the correct direction of rotation to effect removal of cap 12.

The cap and the container may carry indicia such as a pair of arrows 30, 32 (FIG. 1), which when rotationally aligned, properly position an inward projection 28 of the cap with ramped rib 22 of the container neck, so that the indicia 30, 32 may be aligned and the wall pressed at that point, coupled with counterclockwise rotating to open the container.

Cap 12 may be placed on container neck 14 simply in force-fit manner, thereby causing projecting rings 18, 20 to snap one over the other so that the cap assumes the position illustrated in FIG. 4.

Figure 9:
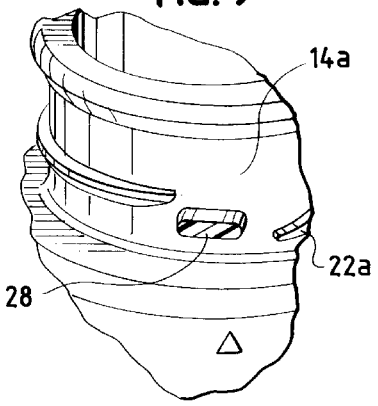
FIG. 9 is a fragmentary, perspective view of a portion of the container neck and one projection of the cap.

FIG. 9 shows a corresponding portion of a container neck 14*a* which defines a corresponding ramped rib 22*a* and a cap projection 28*a* in which no vertical rib similar to rib 24 in the previous embodiment is present.

Figure 10:
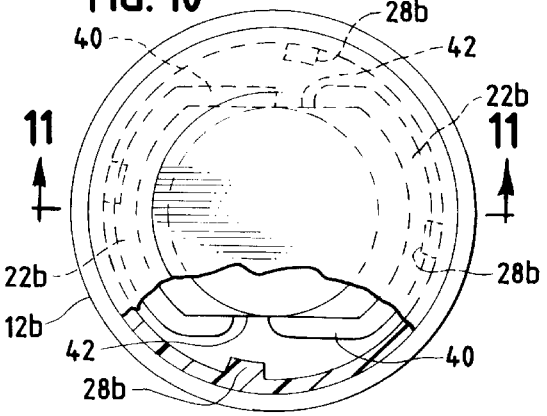
FIG. 10 is a plan view of an alternate embodiment of a closure of this invention, with a portion broken away.
Figure 11:
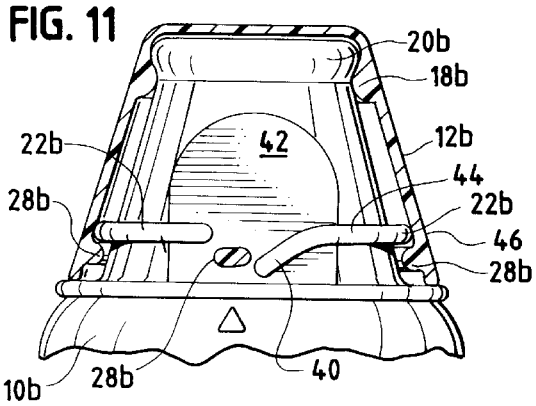
FIG. 11 is a sectional view taken along the line 11—11 of FIG. 10, in the direction indicated generally.

Referring to FIGS. 10 and 11, an alternate embodiment of the container and cap of this invention is shown. In this embodiment, container 10*b* carries a cap 12*b* in a manner which is similar to that previously described. In this embodiment, the container neck defines an outwardly projecting ramped rib 22*b* having a ramp portion 40 which extends downwardly and radially inwardly along a flat section 42 from the balance of rib 22*b*. Thus, it can be seen from FIG. 10 that the inwardly extending projections 28*b* of cap 12*b* can be pressed inwardly to engage ramp portion 40 as in the previous embodiment, but, after sufficient rotation has taken place, the respective cap projections 28*b* will overlie the circumferential, non-sloping portions 44 of ramped rib 22*b* without any need to compress the cap sidewall, for example as at sidewall portion 46.

Thus, cap 12*b* is firmly held on the container not only by the detent rings 18*b*, 20*b* as in the previous embodiment, but also by the engagement of projections 28*b* under the horizontal portion 44 of ramped rib 22*b*.

It can be seen from FIG. 10 that a pair of opposed, C-shaped ramped ribs 22*b* are provided, each terminating on a flat surface 42 of the container neck. Each ramped rib thus can engage a separate, inward projection 28*b* of the cap at its respective ramped portion 20. Thus, to open the container, the user rotates cap 12*b* to the right as viewed in FIG. 11, or counterclockwise as shown in FIG. 10, causing the nearest inward projection 28*b* to be raised by ramped portion 40 of rib 22 when the adjacent portions of the sidewall are pressed inwardly. Otherwise, the cap simply rotates. Projections 28*b,* and the attached cap 12*b,* are forced upwardly to the upper level of non-sloping sections 44 of the ramped ribs. When all of the inward cap projections 28*b* have been so raised, cap 12*b* is freed from its retention to the container, with detent ribs 18*b,* 20*b* automatically disengaging during the process.

In this embodiment, to reattach the cap, it must be reapplied and rotated in the opposite direction until the respective inward projections 28*b* are all under the respective ramped ribs 22*b.*

Figure 12:
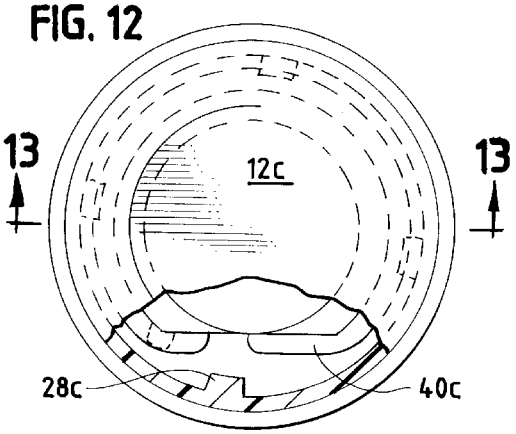
FIG. 12 is a plan view of a further alternate embodiment of a closure of this invention, with a portion broken away.
Figure 13:
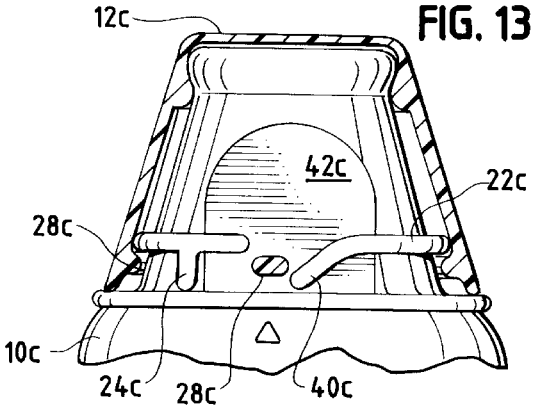
FIG. 13 is a sectional view taken along the line 13—13 of FIG. 12, in the direction indicated generally.

Referring the FIGS. 12 and 13, another alternate embodiment of the invention is shown. Container 10*c* is closed by a cap 12*c,* which is of a design that may be substantially similar to the design of cap 12*b,* having a series of inward projections 28*c.* The corresponding, single ramped rib 22*c* of the container may in this embodiment almost surround the neck of the container, being a single rib, and not a pair of spaced, facing ribs as in the previously described embodiment. The container neck in this embodiment has a single, flat face 42*c,* with rib 22*c* having a single ramp portion 40*c* for receiving and elevating the cap projections 28*c* in a manner similar to the previously described embodiment.

In this embodiment, a vertical rib 24*c,* of a structure and function similar to the corresponding rib of FIGS. 1–8, is provided, so that, when compressed inwardly by the user along with the cap wall, a projection 28*c* will engage vertical rib 24*c* to prevent rotation in the wrong direction when the user is attempting to remove the cap. Without compression of the cap sidewall, the respective projections 28*c* can pass outside of rib 24*c,* so that the cap can rotate freely.

Figure 14:
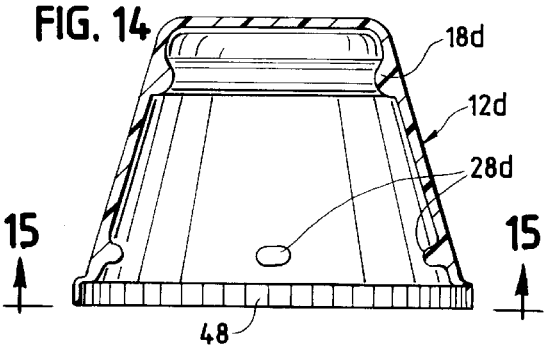
FIG. 14 is a sectional view of a cop in accordance with this invention having a break-away tamper band.
Figure 16:
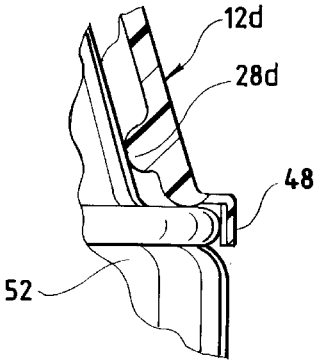
FIG. 16 is an enlarged, detailed view of a portion of the cap of FIG. 14 shown attached to a container neck.
Figure 15:
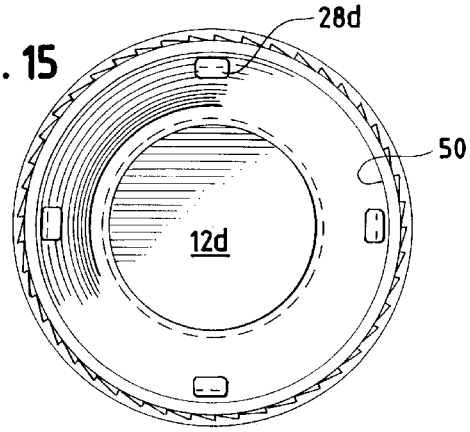
FIG. 15 is a view taken along the line 15—15 of FIG. 14, in the direction indicated generally.

Referring to FIGS. 14 through 16, another design of cap 12*d* is shown for use with the containers disclosed previously. Cap 12*d* carries a snap ring 18*d* of the type similar to those previously described, plus the inward cap projections 28*d* for engaging a ramped rib as previously described.

As a structural distinction, cap 12*d* carries a bottom tamper band tear strip 48, having a serrated inner surface 50 for retention on a container 52 as sown in fragmentary manner in FIG. 16. It can be seen that the walls of cap 12*d* cannot be manually pushed inwardly as long as tear strip 48 remains intact. Thus, as is common in tamper proof containers, tear strip 48 must be removed before the cap can be removed.

The above has been offered for illustrative purposes only, and is not intended to limit the scope of the invention of this application, which is as defined in the claims below.

I claim:

1. A child-resistant closure comprising a container having a top portion with a projecting neck and mouth covered by a flexible cap of inverted cup shape, and a detent member comprising a cap annular rib extending inwardly from the cap interior and a container annular rib extending outwardly from the container neck above the cap annular rib holding the cap in a position closing the container mouth but permitting cap rotation, said neck having a generally rounded periphery in cross section including at least one vertical flat surface, said inverted cap having a top, a sidewall with an internal surface and a peripheral base in confronting relation with said container top, said neck having an outwardly projecting integral rib comprising a circular portion parallel with said container peripheral base and with a ramp end on said flat surface angled toward said cap peripheral base to space said ramp end at a greater distance from said internal cap surface than the spacing of said circular portion, said cap having at least one projection extending inwardly from said cap internal surface at a location between said cap peripheral base and below said circular rib portion, whereby said sidewall may be squeezed to engage said projection and ramp end and rotated with the cap in one direction with the ramp end raising the projection to force the cap upwardly to open the container by disengaging the detent member from its cap-holding position.

2. The closure as claimed in claim 1, wherein said integral rib circular portion extends around the neck terminating in said flat surface spaced from said ramp end.

3. The closure as claimed in claim 2, in which said container neck includes a vertical rib spaced from said ramp end to prevent rotation of said projection away from said ramp end when the cap is squeezed and rotated.

4. The closure as claimed in claim 2, including a plurality of spaced projections mounted below said circular rib portion to resist unauthorized cap removal.

5. The closure as claimed in claim 1, including indicia on said cap and container to align said cap in a position for the projection to engage said ramp end when the cap is squeezed and rotated.

6. The closure as claimed in claim 1, including a tamper band tear strip joined to said cap peripheral base and encircling said container top portion.

7. A child-resistant closure comprising a container having a top portion with a projecting neck and mouth covered by a flexible cap of inverted cup shape, and a detent member comprising a cap annular rib extending inwardly from the cap interior and a container annular rib extending outwardly from the container neck above the cap annular rib holding the cap in a position closing the container mouth but permitting cap rotation, said inverted cap having a top, a sidewall with an internal surface and a peripheral base in confronting relation with said container top, said neck having a generally rounded periphery in cross section including first and second opposed vertical flat surfaces and first and second outwardly projecting integral ribs parallel with said peripheral base, each having a circular portion and terminating ends, said first rib terminating on said first flat surface with a ramp end angled toward said cap peripheral base to space said ramp end at a greater distance from said internal cap surface than the spacing of said circular portion, said first rib terminating on said second flat surface in a straight termination, said second rib terminating at one end on said second flat surface with a ramp end similar to said first rib and terminating at said other end on said first flat surface similar to said first rib, said cap having a plurality of projections extending inwardly from said cap internal surface at a location between said cap peripheral base and below said circular rib portion, whereby said sidewall may be squeezed to engage a projection and ramp end and rotated with the cap raising the projection to force the cap upwardly to open the container by disengaging the detent member from its cap-holding position.

8. The closure as claimed in claim 7, including indicia on said cap and container to align said cap in a position for a projection to engage a ramp end when the cap is squeezed.

9. A child-resistant closure comprising, a container having a neck and mouth covered by a flexible cap of inverted cup shape having a sidewall and internal surfaces and a peripheral base, a detent member comprising a cap annular rib extending inwardly from the cap interior and a container annular rib extending outwardly from the container neck above the cap annular rib holding the cap in a position closing the container mouth but permitting cap rotation, said neck having at least one vertical flat surface on its periphery and an integral outwardly projecting rib parallel with said peripheral base and terminating in a ramp end on said flat surface, said cap having a projection extending inwardly from a sidewall internal surface and manually engageable with said ramp end by squeezing said sidewall wherein rotation of said cap with the projection on said ramp end raises the projection to force the cap upwardly thereby disengaging the detent member from its cap holding position.

10. The closure as claimed in claim 9 wherein said ramp end is spaced from said internal surface at a greater distance than the spacing between the circular portion and the internal surface.

* * * * *